United States Patent [19]

Barna

[11] 4,275,646

[45] Jun. 30, 1981

[54] KITCHEN UTENSIL FOR MAKING FLAVORED BEVERAGES

[76] Inventor: Stephen L. Barna, 1129 N. State Rd., Ionia, Mich. 48846

[21] Appl. No.: 76,487

[22] Filed: Sep. 17, 1979

[51] Int. Cl.[3] ..... A47G 19/16

[52] U.S. Cl. ..... 99/323; 30/326; 294/99 R; 426/82

[58] Field of Search ..... 99/323; 30/325, 326, 30/253, 142; D7/47, 104; 294/99 R; 24/255 R; 426/77, 82, 110; 210/470; 241/95; 100/213, 234, 265, 125

[56] References Cited

U.S. PATENT DOCUMENTS

| | | | |
|---|---|---|---|
| D. 85,789 | 12/1931 | Taintor | D7/104 |
| 453,972 | 6/1891 | Gray | 99/323 |
| 1,756,250 | 4/1930 | Kreuter | 100/234 |
| 1,806,441 | 5/1931 | Bauer et al. | 294/99 R |
| 2,010,074 | 8/1935 | Fuerst | 294/99 R X |
| 2,024,849 | 12/1935 | Eliopoulos | 294/99 R |
| 2,111,195 | 3/1938 | Skau | 294/99 R X |
| 2,483,985 | 10/1949 | Sonn | 100/234 |
| 2,653,048 | 9/1953 | Novak | 294/99 R |
| 2,757,951 | 8/1956 | Benton | 294/99 R X |
| 2,768,856 | 10/1956 | Wright | 294/99 R |
| 2,839,325 | 6/1958 | Jeanfavre | 294/99 R |
| 2,891,814 | 6/1959 | Idoine | 294/99 R |
| 3,755,895 | 9/1973 | Claasen | 426/82 X |
| 4,157,680 | 6/1979 | Charles | 100/125 |

FOREIGN PATENT DOCUMENTS

| | | | |
|---|---|---|---|
| 682770 | 10/1939 | Fed. Rep. of Germany | 30/326 |
| 2642886 | 3/1978 | Fed. Rep. of Germany | 99/323 |
| 250036 | 5/1948 | Switzerland | 99/323 |
| 2716 | of 1894 | United Kingdom | 99/323 |
| 10574 | of 1907 | United Kingdom | 99/323 |

*Primary Examiner*—Billy J. Wilhite

*Attorney, Agent, or Firm*—Price, Heneveld, Huizenga & Cooper

[57] ABSTRACT

The specification discloses a kitchen utensil for making flavored beverages such as hot tea, and the like, and comprises a pair of arms having one set of ends pivotally interconnected, and apertured bowl members mounted on the other arm ends, and including a leaf spring selectively retaining the bowl members together in a closed position to prevent a flavoring agent substrate from inadvertently escaping therefrom.

13 Claims, 7 Drawing Figures

KITCHEN UTENSIL FOR MAKING FLAVORED BEVERAGES

BACKGROUND OF THE INVENTION

The present invention relates to utensils, and in particular to a kitchen utensil for making flavored beverages, such as tea, and the like.

Perforated holders for flavoring agents, such as tea, herbs, and the like, are well-known in the culinary arts for making flavored drinks. Typically, such devices are used in the preparation of hot drinks, by placing a flavoring agent in a perforated bowl, and flowing hot water therethrough, such that the essence of the flavoring agent is imparted to the water. Heretofore, such devices were of a complicated, rather intricate design, such as that disclosed in the Gray U.S. Pat. No. 453,972, with several small interlocking parts to open and close the foraminous bowl members. Such utensils are not only quite costly to manufacture, but also cumbersome to operate, easily damaged, and deteriorate quickly, particularly when used with highly acidic, hot beverages such as tea.

SUMMARY OF THE INVENTION

The present invention provides a kitchen utensil with aperted bowl members on the free ends of tong arms to present a simple construction for reliable operation and a long operating life, which will securely retain a flavoring agent therein during use. The apertured bowls converge and diverge in response to manipulation of the tong arms, thereby avoiding fouling of the utensil parts, and permitting easy insertion and removal of the flavoring agent from the bowls. The utensil includes means which retain in a closed position to prevent the flavoring agent substrate from escaping from the bowls.

Another aspect of the present invention is to provide a tong with a U-shaped handle constructed of a relatively thin material, and a separate leaf spring which is releasably secured with the handle and resiliently urges the free ends together, and retains the same in a closed position. The separate leaf spring provides strength which is lacking in using the thinner material for the tong handle.

Yet another aspect of the present invention is to provide a kitchen utensil for making flavored beverages which includes mating bowl members with a plurality of lanced slots therethrough.

Yet another aspect of the present invention is to provide a kitchen utensil with apertured bowls mounted on the free ends of the tong arms, and a snap lock arrangement for positively locking the bowl members together in a closed position.

These and many other important advantages of the invention will be further understood and appreciated by those skilled in the art by reference to the following written specification, claims, and appended drawings.

DETAILED DESCRIPTION OF THE PREFERRED EMBODIMENTS

Figure 1:
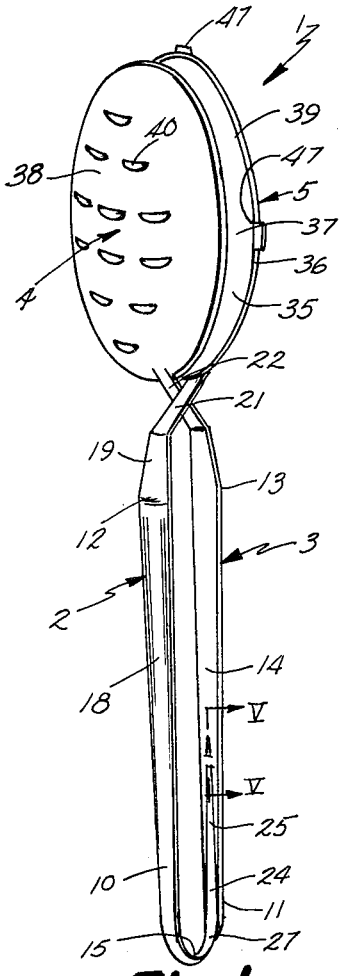
FIG. 1 is a perspective view of a kitchen utensil embodying the present invention.
Figure 2:
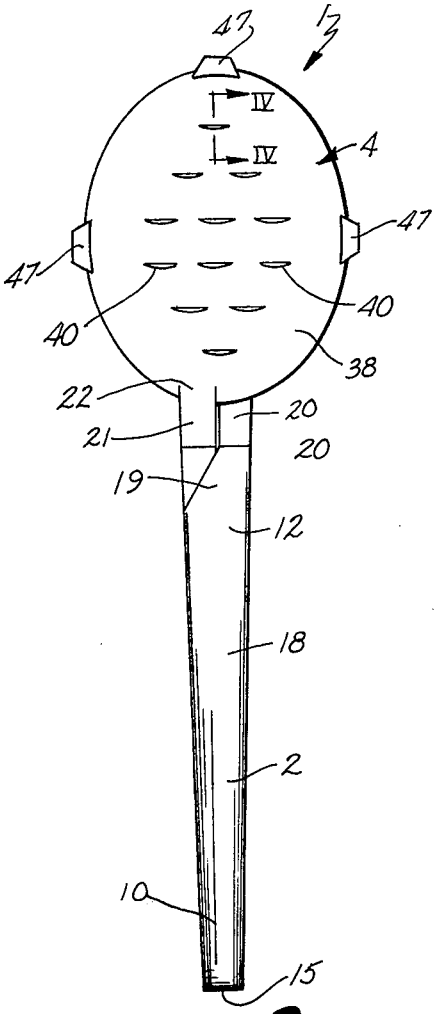
FIG. 2 is a front elevational view of the utensil.
Figure 3:
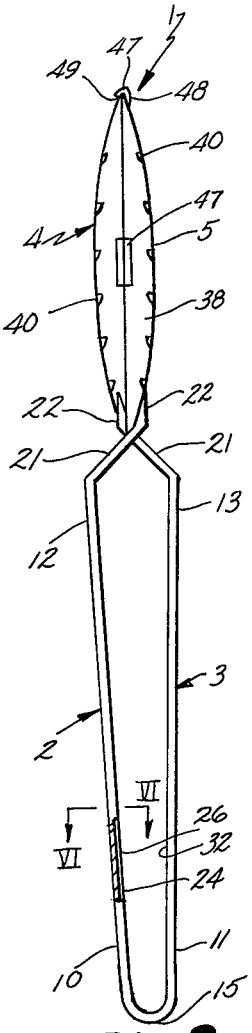
FIG. 3 is a side elevational view of the utensil, with a portion thereof broken away to reveal internal construction.

For purposes of description herein, the terms "upper", "lower", "right", "left", "rear", "front", "vertical", "horizontal", and derivatives thereof shall relate to the invention as oriented in FIGS. 1–3. However, it is to be understood that the invention may assume various alternative orientations, except where expressly specified to the contrary.

The reference numeral 1 generally designates a kitchen utensil embodying the present invention for making flavored beverages, and comprises a pair of arms 2 and 3 having one set of ends pivotally interconnected, and apertured bowl members 4 and 5 mounted on the other arm ends. Means are provided for selectively retaining the bowl members in a closed position during use, to prevent a flavoring agent substrate from inadvertently escaping therefrom.

The arms 2 and 3 each have first and second ends 10—13 respectively, with the first ends 10 and 11 oriented lowermost in the structure illustrated in FIGS. 1–3, and the second ends 12 and 13 oriented uppermost. The lower arm ends 10 and 11 are pivotally interconnected to selectively converge and diverge the upper ends 12 and 13 of the arms. In the illustrated structure, the arms 2 and 3 are in the nature of tongs with a U-shaped handle having a pair of legs which correspond to the arms 2 and 3. The handle legs 2 and 3 are interconnected by a loop or arcuately shaped end member 15. The handle legs 2 and 3 and end member 15 are preferably integrally formed, and are semi-rigid and resilient to urge the bowl members 4 and 5 together, and retain the same in a normally closed position. In the examples illustrated in FIGS. 1–3, the handle legs 2 and 3 taper slightly outwardly from the end member 15 to the upper ends 12 and 13, and include an exterior surface 18 thereof which is adapted for grasping by the user to facilitate manipulation of the utensil. The exterior surface 18 of both of the handle legs 2 and 3 is preferably arcuately shaped to comfortably fit the user's hand, and may be textured to alleviate slippage. This shape helps retain a leaf spring 24 in place, preventing it from sliding off to the side. Also, this shape lends strength to the legs so as to minimize the need for thick metal legs. Thinner gauge material can be employed.

The upper ends 12 and 13 of each of the handle legs includes a trapazoidal portion 19 with a side edge thereof inclined inwardly toward the medial portion of the arm. A connecting leg 21 extends upwardly from each of the trapazoidal portions 19, and is bent inwardly along an edge 20 toward the opposing arm at an obtuse angle. Each of the connecting legs 21 has an upper, terminal end portion 22, which is fixedly attached to an outside surface of an associated one of the bowls 4 and 5 by suitable means such as welding or adhesive. In the illustrated structure, the connecting legs 21 are integrally formed with the associated bowl members 4 and 5, such that the handle and bowl members are integrally formed in a one-piece construction.

Figure 5:
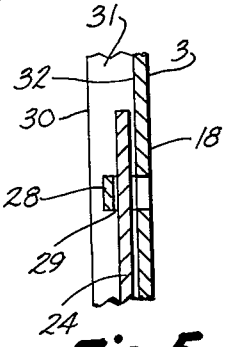
FIG. 5 is an enlarged, fragmentary cross sectional view of the utensil taken along the line V—V, FIG. 1.
Figure 6:
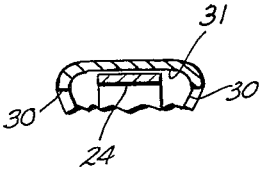
FIG. 6 is an enlarged fragmentary view of the utensil taken along the line VI—VI, FIG. 3.

The handle 14 preferably includes a separate leaf spring member 24 which is releasably connected therewith to resiliently urge or bias the bowl members 4 and 5 into a closed position and retain the same therein. The use of the separate leaf spring 24 permits the bowl and handle member 14 to be constructed of a very light gauge steel in a nature 0.015 inches thick to reduce material and fabrication costs, without sacrificing the operational characteristics of the utensil. The end member 15 is flexible and inelastically deformable, and the leaf spring 24 imparts the resiliency to the tong assembly. The leaf spring 24 is an elongate strip, which is preferably constructed of a somewhat stiff plastic, spring steel, or the like, and is formed into a U-shaped structure with legs 25 and 26, and an arcuate end 27, which are shaped in a manner respectively similar to the arms 2 and 3, and end member 15 of the handle, and are adapted to overlie the same. As best illustrated in FIGS. 1 and 5, retainers or straps 28 are formed in a medial portion of each of the handle legs 2 and 3, extend transversely thereacross, and form a slot 29 which is shaped to telescopically receive therein an associated end of the leaf spring 24, so as to quickly and easily connect the leaf spring with the handle, without requiring any special tools to accomplish the assembly. The straps are preferbly formed by lancing, wherein parallel slits are cut into handle, and the material disposed between the slits is bent inwardly. The lanced straps reduce manufacturing costs and provide a strong fastener. As best shown in FIG. 6, the side edges 30 of the handle are preferably rolled over to form a channel 31 in which the leaf spring 24 is cradled and retained. Preferably, the channel 31 is oriented inwardly of the utensil, and the leaf spring 24 overlies an interior surface 32 of the handle legs and end members, so as to conceal the leaf spring from view, and impart a neat, pleasant appearance to the utensil. The straps 28 retain the leaf spring 24 in the channel 31 in a position abuttingly overlying the interior surface 32 of the base or end member 15. In this example, the handle legs 2 and 3 cross over at the upper portion of connecting legs 21 of the handle, and connect with a bowl disposed on an opposite side of the utensil, such that convergence of the handle legs 2 and 3 diverges the bowl members 4 and 5, and vice versa. The leaf spring 24 is shaped and pretensed to urge the handle arms 2 and 3 divergingly apart, so as to retain the bowl members 4 and 5 in a normally closed position.

Figure 4:
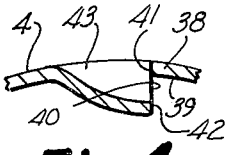
FIG. 4 is an enlarged fragmentary cross sectional view of the utensil taken along the line IV—IV, FIG. 2.

The bowl members 4 and 5 are spoon-shaped or dished, and include a concave base 35 (FIG. 1) and a free, marginal edge 36. The bowl members are connected with the handle arms 2 and 3 by the connecting legs 21, and are oriented thereon with the free edges 36 substantially aligned and facing each other, whereby the bowls matingly abut in a closed position, as shown in FIG. 3, to form a cavity 37 therebetween, and are spaced in an open position, as shown in FIG. 1, to access the cavity. The cavity 37 is shaped to receive and retain a variety of different types of flavoring agents (not shown) therein. The illustrated bowl members 4 and 5 each have a generally oval shape, with a convex exterior surface 38 and a concave interior surface 39. At least one of the bowl members has an aperture therethrough which is sized for communicating the flavoring agent with a fluid, yet preventing the flavoring agent substrate from flowing therethrough. In the illustrated structure, both of the bowl members 4 and 5 include a plurality of apertures therethrough to form a perforated arrangement which permits the fluid to flow transversely through the utensil. Preferably, each of the apertures 40 comprises a lanced slot, which as best illustrated in FIG. 4, is formed by slicing a selected portion of the bowl material along an edge 41, and depressing the sliced edge 42 a spaced apart distance below the mating edge 41 to form the aperture 40 thereinbetween. A concave surface 43 is formed below the sliced edge 42. The lanced slots 40 are preferably positioned in a predetermined pattern on each of the bowl members 4 and 5, with a plurality of the same arranged in a side-by-side fashion through the medial portion of the bowl members, and decreasing therefrom to the upper and lower end portions of the bowls.

A locking arrangement 48 is provided to positively interconnect the bowl members 4 and 5 in a closed position, so as to prevent the flavoring agent substrate from inadvertently escaping from the cavity 37 during use and ruining the beverage. It is to be understood that the term "retaining means" as used herein, defines virtually any mechanism to retain the bowl 4 and 5 in the closed position (FIGS. 2 and 3), and includes the leaf spring 24 and/or the snap lock 47, as well as other specific embodiments of the basic concepts disclosed herein. The illustrated embodiment includes both the leaf spring 24 and the snap lock 47 and provides a dual "retaining" design. The illustrated snap lock comprises an interlocking tab and channel arrangement, which includes three snap-lock channel segments or latches 48 which are spaced regularly about the outer periphery of the bowl member 5. The latches 48 include a groove 49 therein which is adapted to receive a mating portion of the marginal edge of the bowl member 4 therein, and securely interconnect the bowl members.

Figure 7:
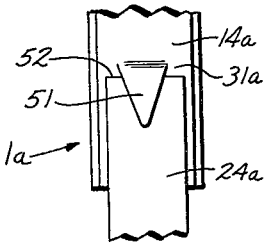
FIG. 7 is an enlarged fragmentary view of another embodiment of the present invention, particularly showing attachment of a leaf spring member to a handle portion of the utensil.

The reference numeral **1*a* (FIG. 7) generally designates another embodiment of the present invention having alternate means for attaching the leaf spring to the handle member. Since the utensil 1*a* is otherwise substantially the same as the previously described device 1, similar parts appearing in FIGS. 1–6 and 7 respectively are represented by the same, corresponding reference numeral, except for the suffix "a" in the numerals of the latter. The handle 14*a* of the utensil 1*a* is substantially similar in shape to the previously discussed utensil handle 14, wherein the leaf spring 24*a* extends along the arms of the handle and around the U-shaped portion thereof. The side edges of handle arms are rolled over to form a U-shaped channel 31*a* in which the leaf spring 24*a* is cradled and retained. In the present utensil 1*a*, a tab 51 is formed on the interior surface 32*a* of both the handle legs 2 and 3 at a position adjacent to the end edge 52 of the leaf spring 24*a*. The tab 51 forms a slot between the interior surface of the handle arm and the lower surface of the tab which is shaped to receive the leaf spring end therebetween and securely retain the same therein. The leaf spring 24*a* abuttingly overlies the interior surface of the handle and end member, thereby constraining the spring ends in a position underneath the tabs 51. Preferably, the tabs 51** is formed by lancing, so as to minimize manufacturing cost.

In the construction of the illustrated utensil 1, the bowl members 4 and 5 and handle member 14 are blanked in one piece from a panel of relatively thin, inexpensive sheet metal. The bowl members 4 and 5 are formed in a concave fashion, and the slots 40 are lanced through each of the same. The handle slots 29 and channels 31 are formed, and the U-shaped end member 15 and angled connecting legs 21 are then formed by bending the blank. The leaf spring 24 is compressed, and the ends thereof are inserted through the slots 29, so as to retain the leaf spring in the handle. The leaf spring 24 resiliently urges the handle arms 2 and 3 divergingly apart, thereby retaining the bowl members 4 and 5 in a normally closed position.

In use, the handle legs 2 and 3 are converged by the user to divege the bowls 4 and 5 and open the cavity 37 so as to place a flavoring agent, such as loose or bagged tea, herbs, or the like, thereinbetween. As the handle arms 2 and 3 are converged, the leaf spring 24 is deformed and tensed. After the flavoring agent has been placed in the bowl cavity, the user simply releases his grasp on the handle legs 2 and 3, whereupon the tension in the leaf spring 24 resiliently diverges the handle arms and forces the bowl members 4 and 5 abuttingly together into a closed position. In the closed position, the bowl members are disposed substantially coaxially, with the marginal edges matingly abutting to form the bowl cavity. The latches 48 on the bowl member 5 frictionally engage the marginal edge of the bowl member 4, and securely lock the bowl members together in a snap fashion so as to prevent the inadvertent escape of the flavoring agent substrate from the bowl cavity. The utensil is then communicated with the fluid to be flavored, such as water, or the like, and is retained therein for a time sufficient to obtain the desired concentration of the flavoring in the fluid. The utensil 1 is next removed from the fluid, and the same is opened by simply converging the handle legs 2 and 3, which releases the snap-lock arrangement of the latches 48, and diverges the bowls 4 and 5 so as to open the cavity and permit removal of the exhaused flavoring agent from the bowl cavity. The tong-like arms and bowl design of the present invention is quite simple in construction, and alleviates the fouling problems experiences in other such devices. As a result of the simplicity of the design, the utensil has a long operating life, and is quite inexpensive to manufacture.

In the foregoing description, it will be readily appreciated by those skilled in the art that many modifications may be made to the invention without departing from the concepts disclosed herein. Such modifications are to be considered as included in the following claims unless these claims by their language expressly state otherwise.

The embodiments of the invention in which an exclusive property or privilege is claimed are defined as follows:

1. A pair of hand held tongs comprising:

a U-shaped body having a pair of arms adapted for grasping, with free ends shaped to clench an object therebetween, and an arcuate, flexible base; said body having a substantially U-shaped cross section which forms an inwardly oriented channel;

a flexible leaf spring having a resilient body with first and second ends; said leaf spring being positioned in said channel at said base, whereby said channel retains said leaf spring in place and conceals the same from view; and means for connecting said first and second leaf spring ends with a different one of said arm first ends.

2. A pair of hand held tongs comprising:

a U-shaped body with a pair of arms adapted for grasping, and having free ends thereof shaped to clench an object therebetween; said body being integrally formed from a thin sheet material, whereby said arms are integrally joined at a U-shaped base which is flexible;

a substantially flat, flexible leaf spring having a resilient body with first and second ends;

releasable securing means connecting said first and second leaf spring ends with a different one of said arm first ends, whereby said leaf spring and said body are quickly and economically assembled; wherein said body has a substantially U-shaped transverse cross section, and forms an inwardly oriented channel; and said leaf spring is positioned in said channel at said base for retaining said leaf spring therein, and concealing the same from view.

3. A pair of tongs as set forth in claim 1 or 2 wherein:

said leaf spring connecting means comprises a pair of lanced straps in said arms which telescopically receive said leaf spring ends therein and retain said leaf spring in said channel in a position abuttingly overlying said base.

4. A pair of tongs as set forth in claim 1 or 2 wherein:

said leaf spring connecting means comprises a pair of lanced tabs in said arms which engage the free ends of said leaf spring and retain said leaf spring in said channel in a position abuttingly overlying said base.

5. A kitchen utensil for making flavored beverages, comprising:

a U-shaped handle having arms with free ends and an arcuate flexible base for selectively converging and diverging the free ends of said handle;

a pair of spoon-shaped bowl members each having a concave base with a free edge, and being connected with a different one of said handle free ends; said bowl members being oriented on said arm free ends with the free edges thereof substantially aligned and facing each other, whereby said bowls matingly abut in a closed position to form a cavity therebetween shaped to receive and retain a flavoring agent therein, and are spaced apart in an open position to access said cavity; at least one of said bowl members having an aperture therethrough sized for communicating the flavoring agent with a fluid while preventing flavoring agent substrate to flow therethrough;

means selectively retaining said bowl members together in said closed position to prevent the flavoring agent substrate from inadvertently escaping from the cavity;

a leaf spring; and a slot in each of said handle arms disposed adjacent said arcuate base, and shaped to receive an associated end of said leaf spring therethrough for easily and quickly interconnecting said leaf spring with said handle, whereby said leaf spring resiliently urges said bowl members together and retains the same in a closed position.

6. A kitchen utensil for making flavored beverages and the like, comprising:

a pair of arms, each having first and second ends;

said arm first ends being pivotally interconnected for selectively converging and diverging the second ends of said arms;

a pair of apertured bowl members connected with a different one of said arm second ends, and shaped to receive and retain a flavoring agent therein;

a leaf spring having a resilient body with first and second ends;

a slot positioned in each of said arms adjacent the first end thereof, and shaped to receive an associated end of said leaf spring therein for quickly and easily interconnecting the same, whereby said leaf spring resiliently converges said bowl members and retains the same in a normally closed position.

7. A utensil as set forth in claim 6, wherein:

said arms comprise a U-shaped handle having said arm first ends integrally interconnected at an arcuate base portion of said handle.

8. A utensil as set forth in claim 7, wherein:

said leaf spring includes legs and an arcuately formed end shaped similar to and overlying said handle base portion.

9. A utensil as set forth in claim 8, wherein:

said slots are formed by a pair of lanced straps which telescopingly receive said leaf spring ends therein and retain said leaf spring overlying said handle base.

10. A utensil as set forth in claim 8, wherein:

said slots are formed by a pair of lanced tabs in said arms which engage the free ends of said leaf spring and retain the same overlying said handle base.

11. A utensil as set forth in claim 9 or 10, wherein:

said handle base portion has a substantially U-shaped transverse cross section, and forms a channel in which said leaf spring is cradled and retained.

12. A utensil as set forth in claim 11, wherein:

said channel is oriented inwardly of said utensil to form an arcuate exterior surface of said arms adapted for grasping; and said leaf spring overlies an interior surface of said handle base portion for concealing leaf spring.

13. A utensil as set forth in claim 12, wherein:

said handle legs cross at the second ends thereof, and are connected with one of said bowl members disposed on an opposite side of said utensil; and said leaf spring reiliently urges said handle legs apart, whereby said bowl members are converged and retained in the closed position.

* * * * *

UNITED STATES PATENT AND TRADEMARK OFFICE

CERTIFICATE OF CORRECTION

PATENT NO. : 4,275,646

DATED : June 30, 1981

INVENTOR(S) : Stephen L. Barna

It is certified that error appears in the above—identified patent and that said Letters Patent is hereby corrected as shown below:

Column 2, line 56:

"trapazoidal" should be --trapezoidal--.

Column 2, line 59:

"trapazoidal" should be --trapezoidal--.

Column 3, line 56:

After "spaced" insert --apart--.

Column 4, line 12:

After "decreasing" insert --regularly--.

Column 5, line 32:

"exhaused" should be --exhausted--.

Column 5, line 35:

"experiences" should be --experienced--.

Column 8, line 13:

After "concealing" insert --the--.

UNITED STATES PATENT AND TRADEMARK OFFICE

CERTIFICATE OF CORRECTION

PATENT NO. : 4,275,646 Page 2 of 2

DATED : June 30, 1981

INVENTOR(S) : Stephen L. Barna

It is certified that error appears in the above—identified patent and that said Letters Patent is hereby corrected as shown below:

Column 8, line 18:

"reiliently" should be --resiliently--.

Signed and Sealed this

*Twenty-ninth* Day of *September 1981*

[SEAL]

*Attest:*

GERALD J. MOSSINGHOFF

*Attesting Officer* *Commissioner of Patents and Trademarks*